US005233318A

United States Patent [19]

Sasaki et al.

[11] Patent Number: 5,233,318

[45] Date of Patent: Aug. 3, 1993

[54] CM TYPE DIRECTIONAL COUPLER

[75] Inventors: Kanemi Sasaki, Miyagi; Mikio Takano, Ohme, both of Japan

[73] Assignee: Kokusai Electric Co., Ltd., Tokyo, Japan

[21] Appl. No.: 859,010

[22] Filed: Mar. 30, 1992

[30] Foreign Application Priority Data

Mar. 29, 1991 [JP] Japan ..... 3-091061
Mar. 29, 1991 [JP] Japan ..... 3-91062

[51] Int. Cl.[5] ..... H01P 5/18

[52] U.S. Cl. ..... 333/109; 333/112; 336/175

[58] Field of Search ..... 333/109, 112, 117–119; 336/175

[56] References Cited

U.S. PATENT DOCUMENTS 2,701,335 2/1955 Sargeant et al. ..... 336/175 X
3,413,574 11/1968 Schroeder ..... 333/119 X
3,678,341 7/1972 Constable ..... 336/175 X

FOREIGN PATENT DOCUMENTS 351861 1/1990 European Pat. Off. ..... 336/175

*Primary Examiner*—Paul Gensler
*Attorney, Agent, or Firm*—Sixbey, Friedman, Leedom & Ferguson

[57] ABSTRACT

A CM type directional coupler comprises a body having a dielectric layer, an annular magnet buried in the dielectric layer, a pair of transmission lines juxtaposed with a predetermined spacing between them in a magnetic area enclosed by the magnetic ring in the dielectric layer, and lead terminals extending from opposite ends of each of the transmission lines to outside of the dielectric layer, and all these elements are formed integrally with each other to provide a single device. Therefore, a large coupling factor and directivity are ensured, and the coupler can be designed very compact. This directional coupler can be manufactured with a highly improved yield and mass-producibility, so it is very suitably usable as a power detector in a portable telephone.

12 Claims, 6 Drawing Sheets

CM TYPE DIRECTIONAL COUPLER

BACKGROUND OF THE INVENTION a) Field of the Invention

The present invention relates to a directional coupler having both capacitances and mutual inductance (CM type) used as a power detector in a mobile radio communication apparatus such as portable radio telephone and the like for control of the transmission output thereof.

b) Description of the Prior Art

In the mobile radio communication apparatuses such as a portable radio telephone, the transmission power must be controlled to an appropriate value in order to prevent an interference between portable apparatuses, communicate with the base station on an optimum transmission power, prevent an intermodulation distortion from taking place, to minimize the battery power consumption or for the similar purposes.

Because of the portability of such radio apparatus, the antenna impedance the transmitter sees is not stable as the apparatus is handled in various manners when in use, as held in hand, moved to the face of user or held in excessively inclined position. Therefore, the power detector used for control of the transmission output must be adapted to detect a predetermined level of power irrespective of any load variation. Namely, it must have such a directivity that it can detect only the power of an incident wave upon the antenna while ignoring the power of a reflected wave. A variety of power detectors have so far been proposed for the above purpose. They are generally classified into the following groups according to their configurations:

(a) Distributed coupling lines are formed on the printed circuit board in the radio communication unit.

(b) For detection of the transmission power by voltage division, an isolator is provided between the transmitter and antenna.

(c) Capacitors and coils are discretely disposed to build a CM type directional coupler.

However, such directional couplers are disadvantageous in the following respects:

(a) Since a portion of the printed circuit board is used for provision of the coupling lines, it takes much time to develop and design such a circuit board.

(b) The isolator itself is expensive.

(c) Since circuit elements such as capacitors, coils, etc. are discretely disposed on a circuit board, it is difficult to assure an appropriate directivity. Also it is extremely difficult to manufacture such a directional coupler. Likewise the compact designing is difficult.

SUMMARY OF THE INVENTION

The present invention has an object to overcome the above-mentioned drawbacks of the prior art by providing a CM type directional coupler designed compact, easy to manufacture and highly mass-producible.

The present invention has another object to provide a CM type directional coupler having a thin design and which provides a great coupling factor and directivity.

The present invention has a still another object to provide a CM type directional coupler adapted as a single device which is surface-mountable.

The above and other objects of the present invention will be apparent by this skilled in the art from reading of the following detailed description of the disclosure found in the accompanying drawings and novelty thereof pointed out in the appended claims.

BRIEF DESCRIPTION OF THE DRAWINGS

FIGS. 3 to 5 show one embodiment of the CM type directional coupler according to the present invention, of which, FIG. 3 is a front view, enlarged in scale, of the CM type directional coupler;

FIG. 4 is a side elevation of the CM type directional coupler;

FIG. 5 is a sectional view taken alone the line V—V in FIG. 3;

FIGS. 6 to 9 show a second embodiment of the CM type directional coupler according to the present invention, of which, FIG. 6 is a front view, enlarged in scale, of the CM type directional coupler;

FIG. 7 is a side elevation of the CM type directional coupler;

FIG. 8 is a sectional view taken alone the line VIII—VIII in FIG. 6;

FIG. 9 is an equivalent circuit diagram of the CM type directional coupler in FIG. 6;

FIGS. 10 to 12 show a third embodiment of the CM type directional coupler according to the present invention, of which, FIG. 10 is a front view, enlarged in scale, of the CM type directional coupler;

FIG. 11 is a side elevation of the CM type directional coupler;

FIG. 12 is a sectional view taken alone the line XII—XII;

FIGS. 13 to 17 show a fourth embodiment of the CM type directional coupler according to the present invention, of which, FIG. 13 is a front view, enlarged in scale, of the CM type directional coupler;

FIG. 14 is a sectional view taken alone the line XIV—XIV;

FIG. 15 is a side elevation of the CM type directional coupler;

FIG. 16 is a plan view of the CM type directional coupler; and

FIG. 17 is a bottom view of the CM type directional coupler.

DETAILED DESCRIPTION OF THE PREFERRED EMBODIMENTS

The preferred embodiments of the CM type directional coupler according to the present invention, usable as a power detector in a portable radio apparatus, will be described with reference the drawings.

Figure 1:
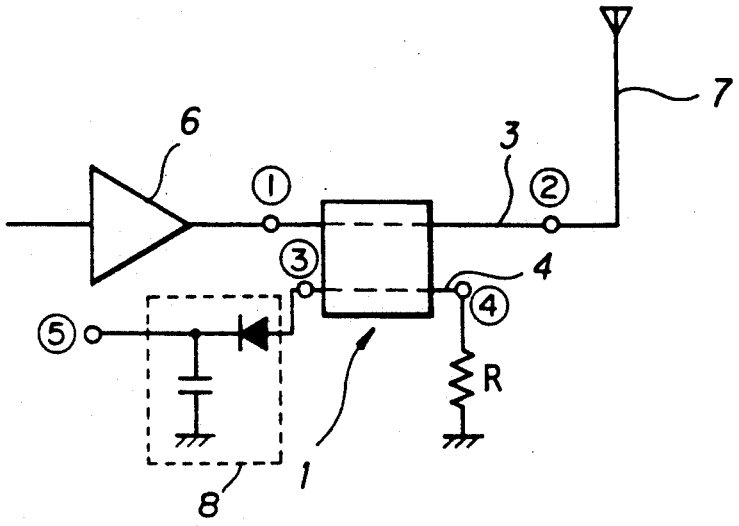
FIG. 1 is a circuit diagram of a CM type directional coupler used as a power detector in a portable radio apparatus for control of the transmission output thereof.
Figure 2:
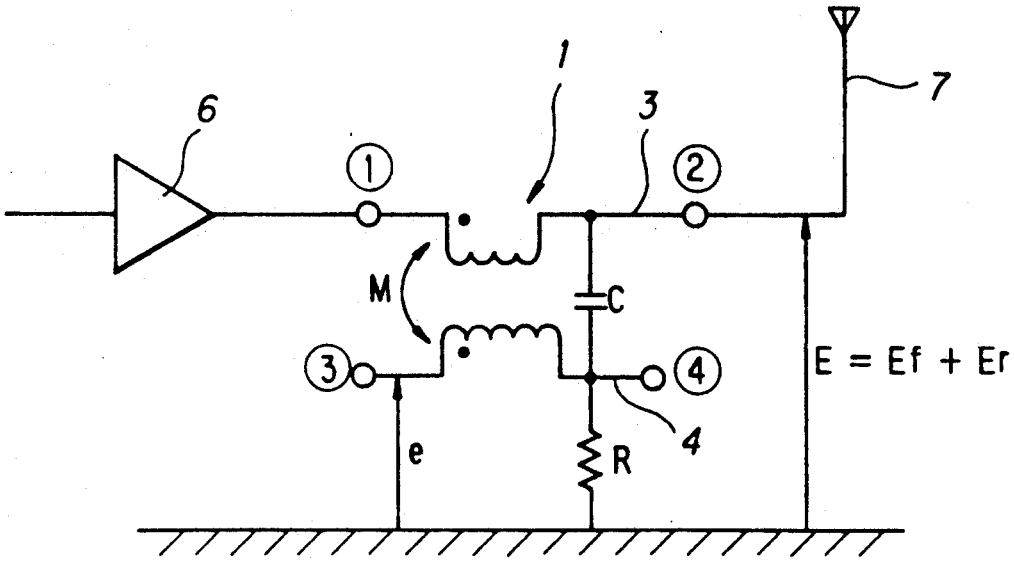
FIG. 2 is an equivalent circuit diagram of the CM type directional coupler in FIG. 1.

First, an example power detector used in a portable radio apparatus for control of the transmission output thereof will be explained by way of example with reference to FIGS. 1 and 2. The reference numeral 1 indicates the directional coupler according to the present invention. It is disposed between a transmitter or power amplifier 6 and an antenna 7. In this power detector, an incident wave power (incident wave voltage: Ef) supplied from the main transmission line 3 passes through the directional coupler 1 and emitted as a radio wave from the antenna 7. A part e of the incident wave power is delivered at a port ③, passes through a detection circuit 8 and is detected as a DC voltage at a port ⑤. The voltage E between a port ② and the ground is expressed by a sum of vector $E=E_f+E_r$ where $E_f$ is an incident wave voltage from the power amplifier and $E_r$ is a reflected wave voltage developed due to mismatching of the antenna 7, and the coupling factor $\alpha$ is defined by $\alpha=20\log_{10}(e/E_f)$ in dB. On the other hand, a part of the wave reflected from the antenna 7 is consumed by a reference resistor R and another part leaks toward a port ③. The directivity $\beta$ is defined by $\beta=20\log_{10}(e/e_r)$ in dB where $e_r$ is the leak of the totally reflected wave voltage $E_r$ of the antenna 7.

Assume here that the leak $e_r$ of the reflected wave voltage $E_r$ is zero, namely, $\beta=\infty$. In this case, the incident wave voltage can be stably monitored irrespective of any mismatching of the antenna 7. In other words, only the incident wave power upon the antenna 7 is detected while the reflected wave voltage is ignored. This can be expressed by the following equation (1) below:

$$CR=M/Z_0 \quad (1)$$

Where M is the mutual inductance between a main transmission line 3 and sub transmission line 4, $Z_0$ is the characteristic impedance of the main line 3, R is the reference resistance and C is the electrostatic capacity between the transmission lines 3 and 4. The incident wave voltage e detected as a voltage between the port ③ and the ground at this time is expressed by the following equation (2):

$$e(j\omega)=j\omega M(2E_f/Z_0) \quad (2)$$

where $E_f$ is the incident wave voltage and $\omega$ is the angular frequency $2\pi f$. The mutual inductance M between the main and sub lines 3 and 4 is expressed by the following equation (3):

$$M=4\pi K\mu_1/C_0 \text{(in nH)} \quad (3)$$

where K is the magnetic coupling factor of the main and sub lines 3 and 4, $\mu_1$ is the relative permeability of magnetic substance and $C_0$ is the core factor. This core factor can be expressed as in the following:

$$C_0=l_e/A_e$$

where $l_e$ is the effective length of magnetic path and $A_e$ is the effective cross-section. The electrostatic capacity C between the transmission lines 3 and 4 is given as a capacity between the transmission lines expressed by the equation (4) below:

$$c=8.855\pi\epsilon_r/ln\{(D+(D^2-A^2)^{\frac{1}{2}})/A\} \text{ in } pF/mm \quad (4)$$

where $\epsilon_r$ is the specific inductive capacity or dielectric constant, A is the conductor diameter and D is the center-to-center distance between the transmission lines 3 and 4.

The CM type directional coupler is designed using the equations (1) to (4) mentioned above. First, the detected voltage e of incident wave is set to a predetermined value, and then a mutual inductance M which will assure that detected incident wave voltage e is determined from the equation (2). Further, a relative permeability $\mu_1$ that will assure such a mutual inductance M and a physical dimension of each portion of the CM type directional coupler are determined from the equation (3) and then a reference resistance R and interline electrostatic capacity C that satisfy the equation (1) are appropriately selected, thereby determining a directivity.

Figure 3:
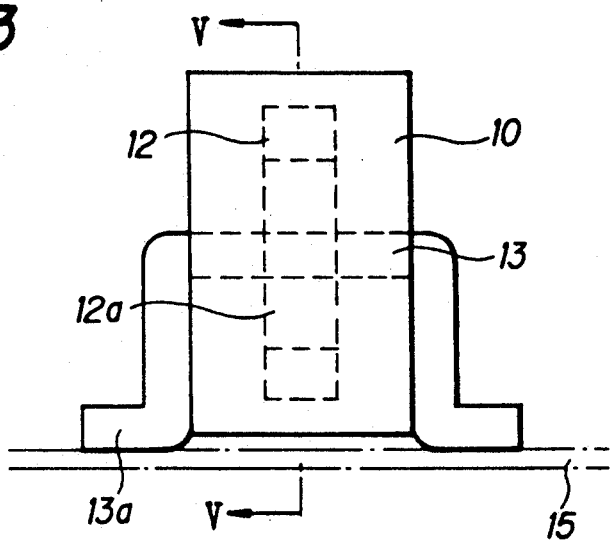
Figure 4:
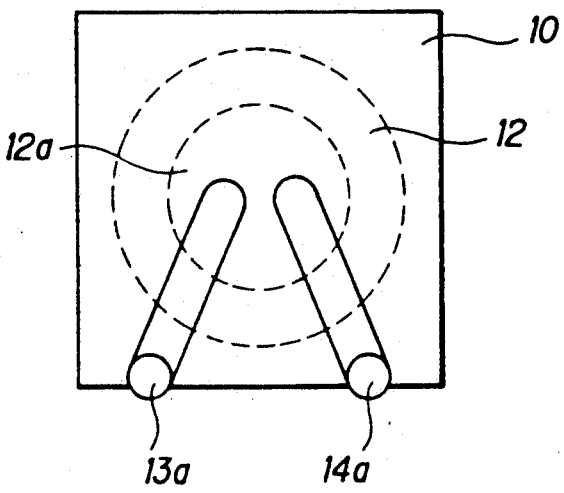
Figure 5:
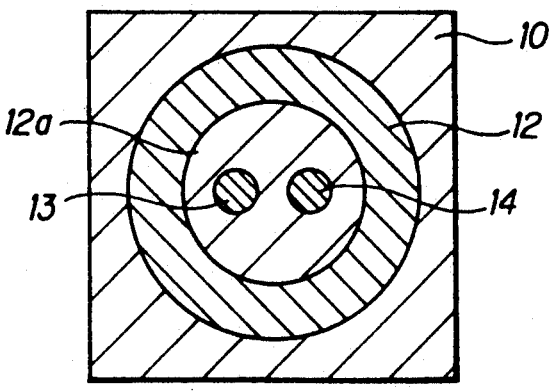
Figure 6:
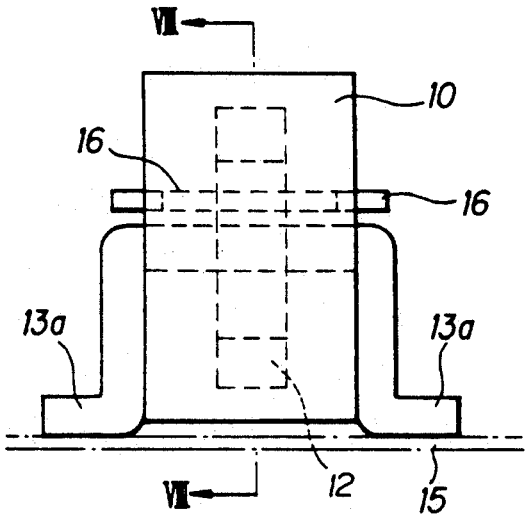
Figure 7:
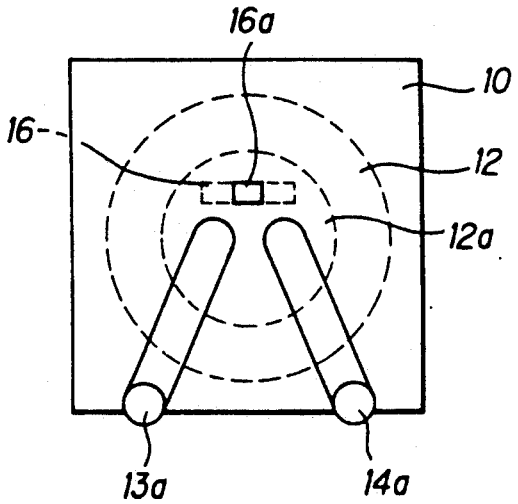
Figure 8:
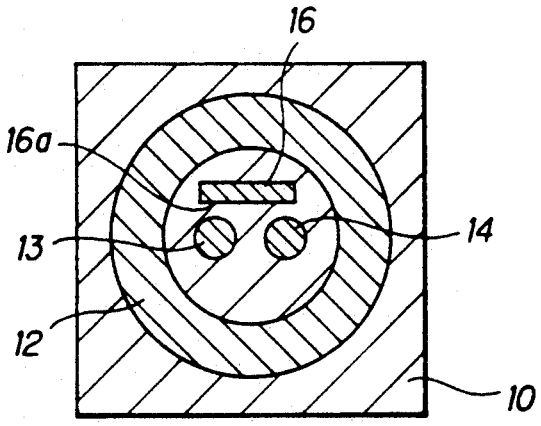

A first embodiment of the CM type directional coupler according to the present invention will be discussed with reference to FIGS. 3 to 5. In the Figures, the reference numeral 10 indicates a resin-made body of the directional coupler. This resin is a PPS (polyphenylene sulfide) having a specific inductive capacity $\epsilon_r=4$. The resin body 10 has buried therein a magnetic ring 12 having main and sub transmission wires 13 and 14 buried in a magnetic area **12*a* inside the dielectric layer ecnlosed by the magnetic ring. The magnetic ring 12 is made of a dust core having a relative permeability of $\mu_1=6$. This dust core is made by adding a binder to a carbonyl iron powder and molding it under pressure into the the form of an annular core. In this embodiment, the magnetic ring is 4 mm in outside diameter and 2 mm in inside diameter. The main and sub transmission lines 13 and 14 are each made of a conductor such as solder-plated copper wire (0.5 mm in diameter), and kept spaced 0.7 mm from each other. Their extensions to outside of the resin body 10 are bent along the side faces of the resin body 10 and also bent in opposite directions parallel to the bottom of the resin body 10 to form lead terminals 13*a* and 14*a*, respectively, for easy mounting to a printed circuit board 15 indicated with a one dot dash line in FIG. 3. The resin body 10 made of a dielectric material, magnetic ring 12, main and sub transmission lines 13 and 14 as a whole are molded by the injection molding process. The resin body 10** is formed as a small rectangular parallelepiped of $3\times4.4\times5.2$ mm.

In the directional coupler according to this embodiment, a coupling factor $\alpha$ of $17\pm0.5$ dB and directivity $\beta$ of 17 dB can be assured at a frequency range of 800 MHz to 1 GHz. The directional coupler according to the present invention is of a very simple and compact design and very excellent in economy and mass-producibility since it can be easily manufactured with an improved yield by the plastic molding technique. Specifically, the directional coupler according to the present invention needs only a mounting space nearly equal to 1/10 of that taken by the conventional directional coupler of the ¼ wavelength coupling line type, thus it is very suitably usable as a power detector in a portable telephone.

FIGS. 6 to 9 show a second embodiment of the CM type directional coupler according to the present invention. The same or similar elements as those in the first embodiment are indicated with the same or similar reference numerals. In the first embodiment, the spacing between the transmission lines is limited to about 0.2 mm for the reason of the molding restrictions, namely, the maximum permissible center-to-center distance (D) between the transmission lines is approximately 0.7 mm when a conductor of 0.5 mm in diameter (A) is used, and thus the electrostatic capacity between the transmission lines is only 0.13 pF/mm under the aforementioned conditions when a PPS resin of $\epsilon_r=4$ in specific inductive capacity is used as the dielectric material for the resin body 10. To avoid this, the second embodiment is so adapted that the distance (D) between the transmission lines can be larger without the necessity of increasing the size of the directional coupler and with no molding restrictions. This is an extremely essential thing. Namely, the CM type directional coupler can be manufactured with a considerably improved molding yield and mass-producibility.

More specifically, an auxiliary conductor 16 is buried opposite to the pair of transmission lines 13 and 14 in the magnetic area 12*a* within the magnetic ring 12 in the dielectric layer of the resin body 10. The auxiliary conductor 16 is formed in the shape of an elongated sheet having a surface area 16*a* substantially parallel to a plane in which the two transmission lines 13 and 14 lie. It is kept out of contact with the pair of transmission lines 13 and 14 and electrically floatable. According to this second embodiment, the end portion 16*a* of the auxiliary conductor 16 projecting from the resin body 10 is so thinned as to easily be cut off after the molding process.

Thus, a mutual inductance will develop between the magnetic ring 12 and the main and sub transmission lines 13 and 14, and electrostatic capacities will take place between the main transmission line 13 and auxiliary conductor 16, and between the sub transmission line 14 and auxiliary conductor 16, respectively.

Figure 9:
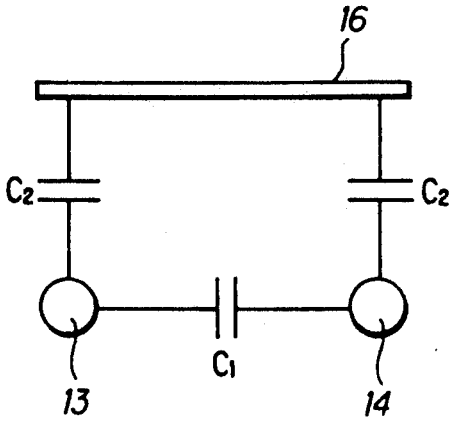

FIG. 9 is a simplified equivalent circuit intended for explanation of such an increased electrostatic capacity. An electrostatic capacity $C_1$ takes place between the main and sub transmission lines 13 and 14, $C_2$ between the main transmission line 14 and auxiliary conductor 16, and also $C_2$ between the sub transmission line 14 and auxiliary conductor 16, thus an electrostatic capacity of $C_1+C_2/2$ will develop between the main and sub transmission lines 13 and 14. The electrostatic capacity will increase by a total of $C_2/2$. Hence, for the same electrostatic capacity between the transmission lines as in the first embodiment, the center-to-center distance between the lines can be maximized for a remainder $(C_1-C_2/2)$ of the subtraction of the increase in electrostatic capacity $(C_2/2)$ from the electrostatic capacity $(C_1)$ between the transmission lines 13 and 14. Actually, the coupling factor can be increased by increasing the electrostatic capacity without the necessity of changing the conductor diameter, conductor spacing of the pair of transmission lines and the mutual inductance due to the magnetic ring. Eventually, the coupling factor can be further increased without increasing the size of the directional coupler as a single device. Therefore, the directional coupler according to the present invention is suitably applicable to a digital cordless telephone of a TDMA (time divisional multiple access) which has a smaller transmission output than that in the ordinary portable telephone but needs a larger coupling factor. The auxiliary conductor 16 is in the form of a sheet in this embodiment. However, it is not limited in form to such a sheet but it may take the form of a wire.

Figure 10:
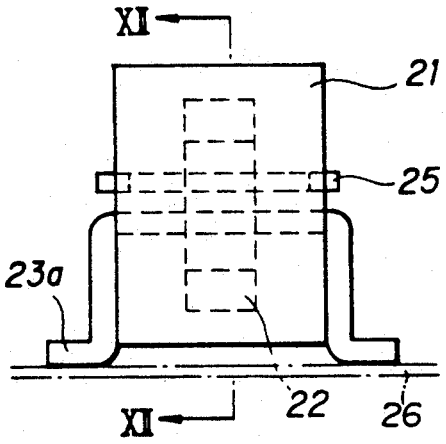
Figure 11:
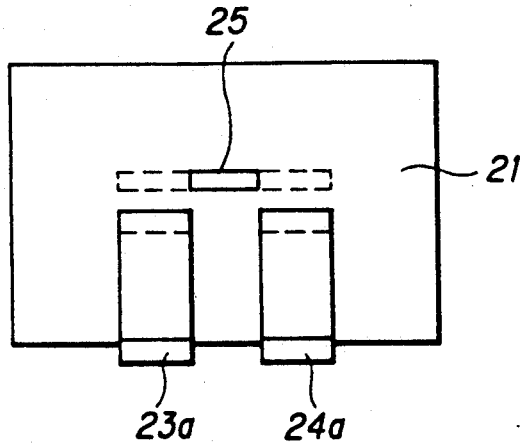
Figure 12:
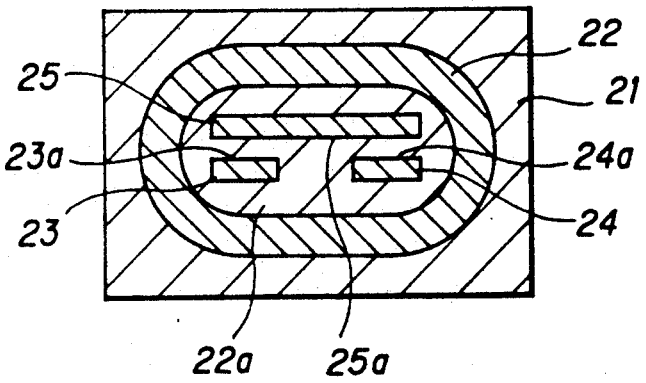

FIGS. 10 to 12 show a third embodiment of the CM type directional coupler according to the present invention. As shown in FIG. 12, this embodiment consists of a resin body 21, an oblate magnetic ring 22 buried therein, a pair of flat conductors, namely, main and sub transmission lines 23 and 24 juxtaposed with a predetermined spacing between them, and an auxiliary conductor 25 having the form of a wide sheet, disposed with a predetermined spacing from the flat transmission lines. The main transmission line 23 has the surface 23*a* thereof laid in a same plane as the surface 24*a* of the sub transmission line 24, and these surfaces 23*a* and 24*a* are parallel to the surface 25*a* of the auxiliary conductor 25. The respective extensions of the main and sub transmission lines 23 and 24 to outside of the resin body 10 are bent along the side faces of the resin body 21 and also bent in opposite directions parallel to the bottom of the resin body 21 to form flat lead terminals 23*a* and 24*a*, respectively, for easy mounting to a printed circuit board 26 indicated with a one dot dash line in FIG. 10.

In this embodiment, because the oblate magnetic ring 22, the pair of flat transmission lines 23 and 24 laid in a same plane and the flat auxiliary conductor 25 disposed in parallel to both these transmission lines are employed, most of the electrostatic capacity required between the main transmission line 23 and auxiliary conductor 25 is a sum of the electrostatic capacity between the main transmission line 13 and auxiliary conductor 25 and that between the sub transmission line 24 and auxiliary conductor 25. Since the area in which the main and sub transmission lines face the auxiliary conductor is wide, a correspondingly large electrostatic capacity can be obtained in total. Because the magnetic ring 22 is oblate, it has a marginal lateral dimension, so that it can take a free form fitting a pitch with which the circuit board components are mounted. Thus, the directional coupler can be designed with a major consideration given to the mounting pitches of various circuit board components in conjunction with the directional coupler, and the design freedom can be improved very much. Furthermore, the CM type directional coupler can be reduced in height. The lead terminals 23*a* and 24*a* can be easily formed by simply bending downward the extensions of the transmission lines 23 and 24 to outside of the resin body 10 after the molding process.

In the above-mentioned first to third embodiments of the present invention, the PPS resin (polyphenylene sulfide) is used to build the dielectric resin body. However, the material of the resin body 10 is not limited to this PPS resin, but any other dielectric resin may be used which would have an appropriate thermal resistance and dynamical properties.

Figure 13:
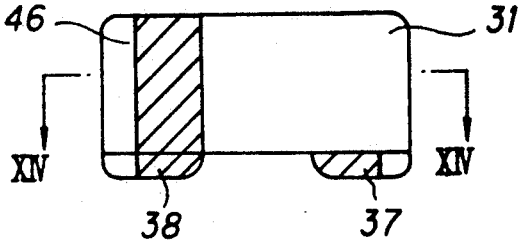
Figure 14:
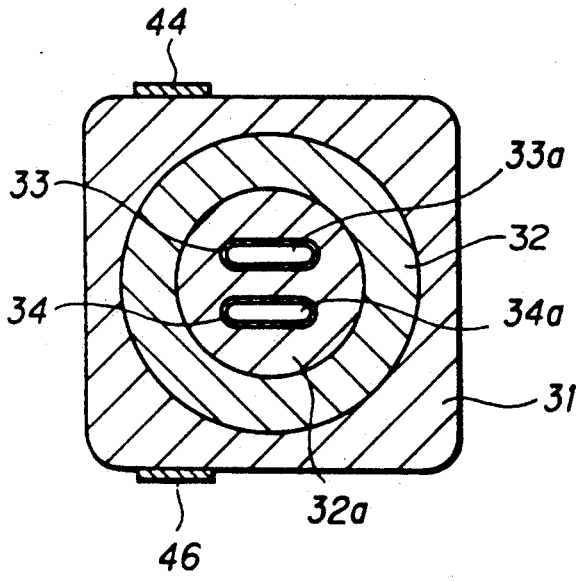
Figure 15:
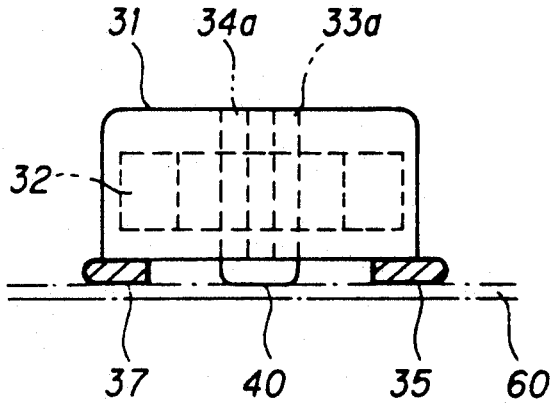

FIGS. 13 to 17 show a fourth embodiment of the CM type directional coupler according to the present invention. As shown in FIG. 14, this embodiment comprises an oblate magnetic ring 32 buried in a resin body 31. In the first to third embodiments, the magnetic ring is disposed in a generally upright position, but in this embodiment, the magnetic ring 32 takes a generally horizontal position. The resin body 31 has a pair of through-holes 33*a* and 34*a* formed through a magnetic area 32*a* of the magnetic ring 32. As shown in FIG. 14, each of the through-holes 33*a* and 34*a* is formed to have an elongated circular section, namely, it consists of two flat walls mutually parallel to each other, each ended by a round wall. The through-holes 33*a* and 34*a* are formed in such a geometric relation between them in the resin body 31 that their flat walls are parallel to each other. Furthermore, these through-holes 33*a* and 34*a* have each a metal layer formed as plated the inner wall thereof. The plated metal layers form a main and sub transmission lines 33 and 34 which will provide between them a mutual inductance and electrostatic capacity required for the CM type directional coupler as in the first to third embodiments. Because the main and sub transmission lines 33 and 34 have a wide flat portion, the electrostatic capacity between them is substantially approximate to that of a capacity consisting of two parallel sheets, and it is greater than that in the first embodiment.

Figure 17:
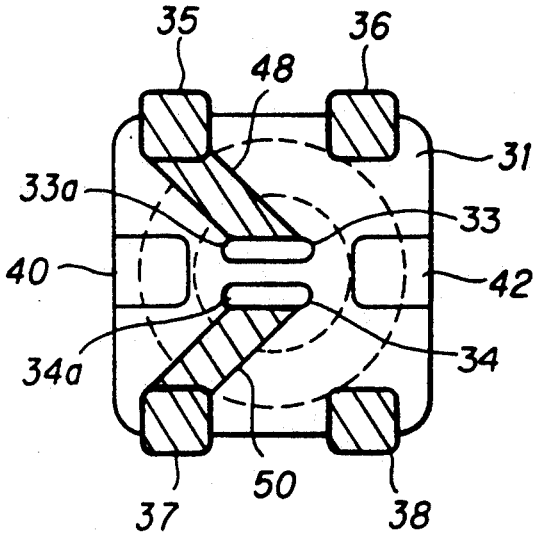

In the fourth embodiment, the resin body 31 is a rectangular parallelepiped having a generally square cross-section, and it has a height considerably reduced as compared with the first to third embodiments. As shown in FIG. 17, the resin body 31 is provided with four projections 35 to 38 adjacent to the four corners, respectively, of the bottom thereof, and also with a further projection 40 formed between the opposite projections 35 and 37 and another projection 42 formed between the opposite projections 36 and 38. The bottom of these projections is formed generally flat for easy mounting to a circuit board 60 indicated with a one dot dash line in FIG. 15.

Figure 16:
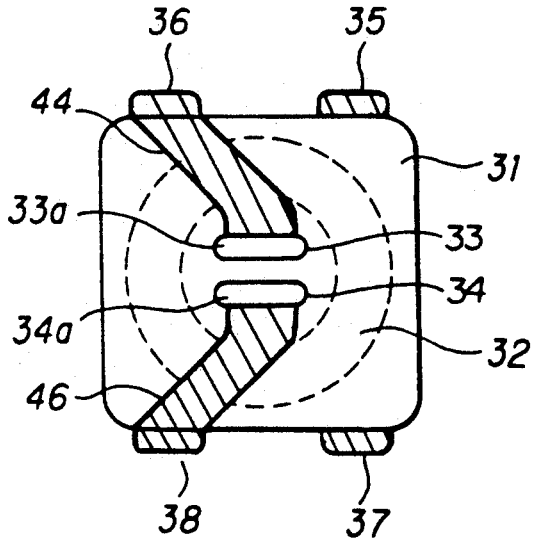

Each of the plated metal layers forming the main and sub transmission lines 33 and 34 are exposed at the upper and lower surfaces of the resin body 31. As shown in FIGS. 13 and 16, metal-plated straps 44 and 46 are formed extending along the side faces of the resin body 31 to the projections 36 and 38, respectively, and connected to the corresponding plated metal layers exposed at the upper surface of the resin body 31. Also, as shown in FIGS. 13 and 17, metal-plated straps 48 and 50 formed extending to the projections 35 and 37, respectively, are connected to the plated metal layers, respectively, exposed at the lower surface of the resin body 31. Each of such plated straps cover the entire surface of each of the projections 35 to 38, thus the projections 35 and 36 form the lead terminals of the main transmission line 33, while the projections 37 and 38 form the lead terminals of the sub transmission line 34. When the CM directional coupler is mounted on the circuit board 60, it has only to be placed with the projections 35 to 38 directed downward correspondingly to the predetermined connecting terminals (not shown) on the circuit board 60. The other projections 40 and 42 are to be fixed to the circuit board with an adhesive applied to corresponding predetermined positions on the circuit board 60.

The aforementioned CM type directional coupler destined for use as a single device is manufactured through a resin molding process and a plating process. First, portions on which metal layers are formed by plating, that is, a cylindrical portion including the through-holes 33*a* and 34*a* in which the main and sub transmission lines 33 and 34 are to be formed, four strap-like portions on which plated straps 44, 46, 48 and 50, and the projections 35 to 38 are initially molded together. The entire surface of this primary molding is subjected to a chemical roughing process to bare the portions where metal layers are to be plated. The primary molding is subjected as insert side to a secondary molding process to provide a secondary molding. Thereafter, the secondary molding is subjected to an electroless plating process to apply metal plating to the bare or exposed portions of the primary molding. Here the manufacture is over. In this embodiment, a liquid-crystalline polymer superior in moldability and high-frequency response is used as the molding material. Also, the electroless plating consists of three processing steps for a copper (Cu) layer as primary layer, nickel (Ni) layer and gold (Au) layer, respectively. The CM type directional coupler according to this embodiment is manufactured through the above-mentioned resin molding and electroless plating processes, but it will of course be apparent to those skilled in the art that the CM type directional coupler can be manufactured by any other known method than such method mentioned above.

Having described our invention as related to the embodiments shown in the accompanying drawings, it is out intention that the present invention be not limited by any of the details of the description, unless otherwise specified, but rather be constructed broadly within its spirit and scope as set out in the accompanying claims.

What is claimed is:

1. A CM type directional coupler, comprising a body having a dielectric layer formed in a rectangular solid, an annular magnet buried in said dielectric layer, a pair of transmission lines juxtaposed with a predetermined spacing between them in a magnetic area enclosed by said magnet in said dielectric layer, and lead terminals extending from opposite ends of each of said transmission lines to outside of said dielectric layer, said lead terminals having extending ends bent in opposite directions parallel to a bottom of said dielectric layer.

2. A CM type directional coupler according to claim 1, wherein said annular magnetic body is a dust core.

3. A CM type directional coupler, comprising a body having a dielectric layer, an annular magnet buried in said dielectric layer, a pair of transmission lines juxtaposed with a predetermined spacing between them in a magnetic area enclosed by said magnetic ring in said dielectric layer, an auxiliary conductor disposed facing said pair of transmission lines in said magnetic area and kept electrically floatable, and lead terminals extending from opposite ends of each of said transmission lines to outside of said dielectric layer.

4. A CM type directional coupler according to claim 3, wherein said auxiliary conductor is formed in the shape of a sheet having a generally flat surface facing said pair of transmission lines.

5. A CM type directional coupler according to claim 3, wherein said annular magnet is formed in the shape of an oblate ring and said pair of transmission lines are formed each in the shape of a sheet having a surface substantially parallel to said surface of said auxiliary conductor.

6. A CM type directional coupler according to claim 4, wherein said lead terminals are formed by the opposite end portions of said pair of transmission lines, which extends to outside of said dielectric layer.

7. A CM type directional coupler according to claim 5, wherein said magnet is a dust core.

8. A CM type directional coupler, comprising a body having a dielectric layer, an annular magnet buried in said dielectric layer, a pair of transmission lines juxtaposed with a predetermined spacing between them in a magnetic area enclosed by said magnetic ring in said dielectric layer and which are formed by metal layers formed as plated on the inner walls of a pair of through-holes formed through said dielectric layer, and lead terminals disposed outside said dielectric layer and electrically connected to opposite ends of said plated metal layers.

9. A CM type directional coupler according to claim 8, wherein said pair of through-holes has a generally elongated circular section, respectively.

10. A CM type directional coupler according to claim 8, wherein said lead terminals are contiguous to the plated metal layers forming said pair of transmission lines and comprise metal-plated straps provided extending along the surface of said body.

11. A CM type directional coupler according to claim 8, wherein said magnetic ring is a dust core and said dielectric layer is a liquid-crystalline polymer.

12. A CM type directional coupler according to claim 10, wherein said body is formed in the shape of a substantially rectangular parallelepiped and two lead terminals contiguous to two plated metal layers exposed at one of two sides of said body are extended to the other side opposite to said one side.

* * * * *